US009490581B2

(12) United States Patent
Ng et al.

(10) Patent No.: US 9,490,581 B2
(45) Date of Patent: Nov. 8, 2016

(54) CONNECTOR INSERT ASSEMBLY

(71) Applicant: Apple Inc., Cupertino, CA (US)

(72) Inventors: Nathan N. Ng, Fremont, CA (US); Zheng Gao, San Jose, CA (US); Mahmoud R. Amini, Sunnyvale, CA (US); Min Chul Kim, Santa Clara, CA (US); Colin J. Abraham, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/543,803

(22) Filed: Nov. 17, 2014

(65) Prior Publication Data

US 2015/0340813 A1 Nov. 26, 2015

Related U.S. Application Data

(60) Provisional application No. 62/003,012, filed on May 26, 2014.

(51) Int. Cl.
*H01R 13/648* (2006.01)
*H01R 13/646* (2011.01)
(Continued)

(52) U.S. Cl.
CPC ..... *H01R 13/646* (2013.01); *H01R 13/658* (2013.01); *H01R 43/20* (2013.01); *H01R 43/26* (2013.01); *Y10T 29/4921* (2015.01); *Y10T 29/49206* (2015.01)

(58) Field of Classification Search
CPC ..... H01R 13/6582; H01R 13/6597; H01R 13/73; H01R 24/60; H05K 1/02; H05K 1/11; H05K 1/05; H05K 1/00
USPC ..... 439/607.28, 660
See application file for complete search history.

(56) References Cited

U.S. PATENT DOCUMENTS 3,128,138 A * 4/1964 Noschese ..... H01R 13/648 439/579
3,587,029 A * 6/1971 Knowles ..... H01R 13/6471 439/108

(Continued)

FOREIGN PATENT DOCUMENTS

CN 101882726 A 11/2010
CN 101908679 A 2/2012

(Continued)

OTHER PUBLICATIONS

Notice of Allowance mailed on Oct. 14, 2015 for U.S. Appl. No. 14/543,768, 9 pages.

(Continued)

*Primary Examiner* — Chandrika Prasad
*Assistant Examiner* — Vladimir Imas
(74) *Attorney, Agent, or Firm* — Kilpatrick Townsend & Stockton LLP

(57) ABSTRACT

Connector inserts having contacts with a high-impedance for good signal integrity and low insertion loss, a pleasant physical appearance, and that may be reliably manufactured. One example may provide connector inserts having signal contacts with a high impedance in order to improve signal integrity to allow high data rates. Another may provide connector inserts having a pleasant appearance by providing features to prevent light gaps from occurring between a plastic tip at a front of the connector insert and a connector insert shield. Another may provide reliable manufacturing by crimping a cap used to secure a cable to a connector insert with a multi-section die, where contacting surfaces of the die include various points or peaks along their surface. These points may effectively wrinkle or jog the perimeter of the cap, thereby reducing the dimensions of a cross-section of the cable.

21 Claims, 9 Drawing Sheets

(51) Int. Cl.

| | |
|---|---|
| ***H01R 43/26*** | (2006.01) |
| ***H01R 13/658*** | (2011.01) |
| ***H01R 43/20*** | (2006.01) |

(56) References Cited

U.S. PATENT DOCUMENTS 4,337,989 A * 7/1982 Asick ..... H01R 13/6595 174/359
4,389,080 A * 6/1983 Clark ..... H05K 7/1053 439/607.01
4,544,227 A * 10/1985 Hirose ..... H01R 13/6583 439/607.17
4,571,012 A 2/1986 Bassler et al.
4,684,192 A * 8/1987 Long ..... H01R 13/629 439/152
4,808,118 A * 2/1989 Wilson ..... H01R 13/6588 439/607.28
4,875,881 A * 10/1989 Caveny ..... H01R 13/73 439/535
4,950,184 A * 8/1990 Caveney ..... H01R 13/73 439/536
5,037,315 A 8/1991 Collier et al.
5,145,385 A * 9/1992 Takano ..... H01R 13/506 439/374
5,164,880 A 11/1992 Cronin et al.
5,221,212 A 6/1993 Davis et al.
5,318,452 A 6/1994 Fortuna et al.
5,382,179 A * 1/1995 Noschese ..... H01R 13/6392 439/369
5,431,578 A * 7/1995 Wayne ..... H01R 13/193 439/259
5,586,911 A * 12/1996 Miller ..... H01R 13/65802 439/607.28
5,591,050 A * 1/1997 Sueoka ..... H01R 23/6873 439/607.28
5,622,522 A * 4/1997 Tan ..... H01R 12/7052 439/607.28
5,674,085 A 10/1997 Davis et al.
5,788,516 A 8/1998 Uggmark
5,913,690 A * 6/1999 Dechelette ..... H01R 23/6873 439/108
5,975,935 A * 11/1999 Yamaguchi ..... H01R 13/73 439/374
5,997,349 A * 12/1999 Yoshioka ..... H01R 9/038 439/579
6,019,616 A * 2/2000 Yagi ..... H01R 13/65802 439/108
6,039,583 A * 3/2000 Korsunsky ..... H01R 23/6873 439/101
6,042,424 A * 3/2000 LaCoy ..... H01R 13/65802 439/579
6,162,089 A 12/2000 Jacobson et al.
6,203,333 B1 3/2001 Medina et al.
6,287,147 B1 9/2001 Lin
6,338,652 B1 1/2002 Ko
6,447,311 B1 9/2002 Hu et al.
6,565,366 B1 5/2003 Wu
6,685,486 B1 2/2004 Zhang et al.
6,736,676 B2 5/2004 Zhang et al.
6,755,689 B2 6/2004 Chu et al.
6,840,806 B2 1/2005 Kodama et al.
6,913,485 B2 7/2005 Ko et al.
6,926,557 B1 8/2005 Yamaguchi et al.
6,981,887 B1 1/2006 Mese et al.
7,052,287 B1 5/2006 Ni et al.
7,074,052 B1 7/2006 Ni et al.
7,086,889 B2 8/2006 Yin et al.
7,086,901 B2 8/2006 Zhang et al.
7,094,103 B2 8/2006 Lai et al.
7,128,588 B2 10/2006 Hu et al.
7,179,124 B2 * 2/2007 Zhang ..... H01R 13/6582 439/188
7,207,836 B2 4/2007 Tsai et al.
7,269,004 B1 9/2007 Ni et al.
7,314,383 B1 1/2008 Ho et al.
7,364,464 B2 4/2008 Shen et al.
7,407,390 B1 8/2008 Ni
7,445,452 B1 11/2008 Wu
7,462,071 B1 12/2008 Wu
7,466,556 B2 12/2008 Hiew et al.
7,497,737 B2 3/2009 Mikolajczak et al.
7,604,497 B2 10/2009 Wu et al.
7,658,617 B1 2/2010 Brodsky et al.
7,670,156 B2 3/2010 Chen
7,686,656 B2 3/2010 He et al.
7,699,663 B1 4/2010 Little et al.
7,753,724 B2 7/2010 Gong et al.
7,837,506 B1 11/2010 Chiang
7,837,510 B1 11/2010 Hung et al.
7,841,905 B2 11/2010 He et al.
7,878,852 B2 2/2011 Hiew et al.
7,883,369 B1 2/2011 Sun et al.
7,997,909 B2 8/2011 Xu et al.
8,011,948 B2 9/2011 Wu
8,011,950 B2 9/2011 McGrath et al.
8,011,968 B2 9/2011 Lai et al.
8,047,875 B2 11/2011 Yamakami et al.
8,052,476 B2 11/2011 He et al.
8,100,720 B2 1/2012 Hsu et al.
8,133,061 B1 3/2012 Ayers, Sr. et al.
8,147,272 B2 * 4/2012 Rhein ..... H01R 13/65802 439/556
8,251,747 B2 8/2012 He et al.
8,298,009 B2 10/2012 Elkhatib et al.
8,393,907 B2 3/2013 Lee et al.
8,454,381 B2 6/2013 Wu
8,475,218 B2 7/2013 Zheng et al.
8,476,110 B2 7/2013 Lee et al.
8,506,317 B2 8/2013 Bandhu et al.
8,545,273 B1 10/2013 Chen
8,567,050 B2 10/2013 Hiew et al.
8,579,519 B2 11/2013 Wu et al.
8,602,822 B2 12/2013 Siahaan et al.
8,662,933 B2 3/2014 Wu et al.
8,696,388 B2 4/2014 Gao et al.
8,708,718 B2 4/2014 Li et al.
8,708,752 B2 4/2014 Wu
8,747,147 B2 6/2014 Yu et al.
8,764,492 B2 7/2014 Chiang
8,794,981 B1 8/2014 Hayashida et al.
8,808,029 B2 8/2014 Castillo et al.
8,808,030 B2 * 8/2014 Gao ..... H01R 13/6271 439/607.4
8,814,443 B2 8/2014 He et al.
8,814,599 B2 8/2014 Wu et al.
8,821,181 B1 9/2014 Lam et al.
8,911,262 B1 12/2014 Leiba et al.
8,992,249 B2 * 3/2015 Kobayashi ..... H01R 13/6591 439/362
9,065,212 B2 * 6/2015 Golko ..... H01R 13/6275
9,065,229 B2 6/2015 Yamaguchi et al.
2002/0001982 A1 1/2002 Sakurada
2002/0142636 A1 10/2002 Murr et al.
2005/0026469 A1 2/2005 Ice et al.
2006/0052005 A1 * 3/2006 Zhang ..... H01R 13/6582 439/607.55
2007/0072446 A1 3/2007 Hashimoto et al.
2007/0111600 A1 5/2007 Tokunaga
2007/0115682 A1 5/2007 Roberts et al.
2007/0254517 A1 11/2007 Olson et al.
2009/0023339 A1 1/2009 Kameyama et al.
2009/0042448 A1 2/2009 He et al.
2010/0248544 A1 9/2010 Xu et al.
2010/0267282 A1 10/2010 Tsai
2010/0303421 A1 12/2010 He et al.
2011/0151688 A1 6/2011 Beaman
2011/0237134 A1 9/2011 Gao et al.
2011/0300749 A1 12/2011 Sytsma et al.
2012/0015561 A1 1/2012 Tsai
2012/0030943 A1 2/2012 Hiew et al.
2012/0282808 A1 11/2012 Luo
2013/0005193 A1 1/2013 Tsai
2013/0045638 A1 2/2013 Gui et al.
2013/0122752 A1 5/2013 Lu

(56) References Cited

U.S. PATENT DOCUMENTS

| | | | | |
|---|---|---|---|---|
| 2013/0164965 | A1 | 6/2013 | Yin et al. | |
| 2013/0183862 | A1 | 7/2013 | Ni et al. | |
| 2013/0217253 | A1 | 8/2013 | Golko et al. | |
| 2013/0244492 | A1 | 9/2013 | Golko et al. | |
| 2013/0288520 | A1 | 10/2013 | Simmel | |
| 2013/0288537 | A1 | 10/2013 | Simmel et al. | |
| 2013/0330976 | A1* | 12/2013 | Simmel | H01R 13/659 439/660 |
| 2014/0024257 | A1 | 1/2014 | Castillo et al. | |
| 2014/0073183 | A1 | 3/2014 | Golko | |
| 2014/0078695 | A1 | 3/2014 | Shih et al. | |
| 2014/0094066 | A1 | 4/2014 | Do | |
| 2014/0113493 | A1 | 4/2014 | Funamura | |
| 2014/0194005 | A1 | 7/2014 | Little | |
| 2014/0220827 | A1 | 8/2014 | Hsu | |
| 2014/0242848 | A1 | 8/2014 | Golko et al. | |
| 2015/0031240 | A1 | 1/2015 | Yang | |
| 2015/0131245 | A1 | 5/2015 | Amini et al. | |
| 2015/0162684 | A1 | 6/2015 | Amini et al. | |
| 2015/0171562 | A1* | 6/2015 | Gao | H01R 13/6582 439/345 |
| 2015/0200493 | A1* | 7/2015 | Gao | H01R 13/6582 439/607.28 |
| 2015/0214673 | A1* | 7/2015 | Gao | H01R 13/6597 439/352 |
| 2015/0340782 | A1 | 11/2015 | Amini et al. | |

FOREIGN PATENT DOCUMENTS

| | | | |
|---|---|---|---|
| CN | 102341970 | A | 2/2012 |
| EP | 1 085 604 | A2 | 3/2001 |
| EP | 2 228 871 | A2 | 9/2010 |
| EP | 2 590 273 | A2 | 5/2013 |
| GB | 2 067 361 | A | 7/1981 |
| WO | 2011/163256 | A1 | 12/2011 |
| WO | 2012/177905 | A2 | 12/2012 |

OTHER PUBLICATIONS

Office Action mailed on Nov. 10, 2015 for U.S. Appl. No. 14/543,717, 16 pages.

International Search Report and Written Opinion of the International Seaching Authority mailed on Mar. 17, 2015 for PCT Patent Application No. PCT/US2015/010253, 12 pages.

Invitation to Pay Additional Fees and, Where Applicable, Protest Fee with Partial International Search Report mailed on Apr. 28, 2015 for PCT Patent Application No. PCT/US2014/065968, 6 pages.

Invitation to Pay Additional Fees and, Where Applicable, Protest Fee with Partial International Search Report mailed on May 4, 2015 for PCT Patent Application No. PCT/US2014/065996, 7 pages.

International Search Report and Written Opinion of the International Seaching Authority mailed on Jul. 3, 2015 for PCT Patent Application No. PCT/US2014/065968, 17 pages.

International Search Report and Written Opinion of the International Seaching Authority mailed on Jul. 10, 2015 for PCT Patent Application No. PCT/US2014/065996, 18 pages.

Office Action mailed on Nov. 17, 2015 for U.S. Appl. No. 14/543,748, 21 pages.

Office Action mailed on Dec. 9, 2015 for U.S. Appl. No. 14/543,711, 15 pages.

Notice of Allowance mailed on Jan. 25, 2016, for U.S. Appl. No. 14/641,353, 8 pages.

Taiwan Office Action mailed on Nov. 23, 2015 for Taiwan Application No. 103139835, 7 pages.

Restriction Requirement Mailed Feb. 16, 2016, for U.S. Appl. No. 14/641,375, 5 pages.

Final Office Action mailed on Mar. 28, 2016 for U.S. Appl. No. 14/543,711, 9 pages.

Notice of Allowance, U.S. Appl. No. 14/543,717, dated May 25, 2016, 8 pages.

Final Office Action, U.S. Appl. No. 14/543,748, dated Jun. 28, 2016, 21 pages.

First Action Interview Pilot Program Pre-Interview Communication, U.S. Appl. No. 14/641,375, dated May 16, 2016, 7 pages.

International Preliminary Report on Patentability, International Patent Application No. PCT/US2014/065968, dated May 26, 2016, 12 pages.

International Preliminary Report on Patentability, International Patent Application No. PCT/US2014/065996, dated May 26, 2016, 14 pages.

Office Action, Chinese Patent Application No. 201410858208.7, dated Jul. 4, 2016, 19 pages.

* cited by examiner

CONNECTOR INSERT ASSEMBLY

CROSS-REFERENCES TO RELATED APPLICATIONS

This application claims the benefit of U.S. provisional patent application No. 62/003,012, filed May 26, 2014, which is incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices. Power may be transferred with this data, or power may be transferred separately.

Power and data may be conveyed over cables that may include wire conductors, fiber optic cables, or some combination of these or other conductors. Cable assemblies may include a connector insert at each end of a cable, though other cable assemblies may be connected or tethered to an electronic device in a dedicated manner. The connector inserts may be inserted into receptacles in the communicating electronic devices to form pathways for power and data.

The data rates through these connector inserts may be quite high. To provide these high data rates, it may be desirable that these connector inserts have a high signal integrity and low insertion loss. This may require the impedance of signal contacts in the connector insert to be high.

These connector inserts may be inserted into a device receptacle once or more each day for multiple years. It may be desirable that these connector inserts have and maintain a pleasant physical appearance as a poor appearance may lead to user dissatisfaction with both the cable assembly and the electronic devices that it connects to.

Electronic devices may be sold in the millions, with an attendant number of cable assemblies and their connector inserts sold alongside. With such volumes, any difficulties in the manufacturing process may become significant. For such reasons, it may be desirable that these connector inserts may be reliably manufactured.

Thus, what is needed are connector inserts having signal contacts with a high-impedance for good signal integrity and low insertion loss, a pleasant physical appearance, and that may be reliably manufactured.

SUMMARY

Accordingly, embodiments of the present invention may provide connector inserts having contacts with a high-impedance for good signal integrity and low insertion loss, a pleasant physical appearance, and that may be reliably manufactured.

An illustrative embodiment of the present invention may provide connector inserts having signal contacts with a high impedance to improve signal integrity and low insertion loss in order to allow high data rates. For example, various embodiments of the present invention may include ground planes between rows of contacts in a connector in order to electrically isolate signals in the different rows from each other. Also, a grounded shield may surround these rows of contacts. The ground plane and shield may increase capacitance to the signal contacts, thereby lowering the impedance at the contacts and degrading signal integrity. Accordingly, in order to improve signal integrity, embodiments of the present invention may thin or reduce thicknesses of one or more of the shield, ground plane, or contacts in order to increase the distances between the structures. This increase in distance may increase the impedance at the contacts.

In other embodiments of the present invention, the shape of a signal contact when it is in a deflected or inserted state may be optimized. For example, a contact may be contoured to be at a maximum distance from the ground plane and shield over its length in order to increase impedance at the contact. In a specific embodiment of the present invention where the ground plane and shield are substantially flat, the signal contacts may be substantially flat as well, and where either or both the ground plane and shield are curved, the signal contacts may be substantially curved as well.

In this embodiment of the present invention, the signal contacts of a connector insert may be designed to be substantially flat when the connector insert is inserted into a connector receptacle. This design may also include a desired normal force to be applied to a contact on a connector receptacle by a connector insert signal contact. From this design, the shape of the connector insert signal contacts when the connector insert is not inserted in a connector receptacle may be determined. That is, from knowing the shape of a connector insert signal contact in a deflected state and the desired normal force to be made during a connection, the shape of a connector insert signal contact in a non-deflected state may be determined. The connector insert signal contacts may be manufactured using the determined non-deflected state information. This stands in contrast to typical design procedures that design a contact beginning with the non-deflected state.

These and other embodiments of the present invention may provide connector inserts having a pleasant appearance. In these embodiments, a leading edge of the connector insert may be a plastic tip. This plastic tip may be a front portion of a housing in the connector insert. Embodiments of the present invention may provide features to prevent light gaps from occurring between the plastic tip and shield. One illustrative embodiment of the present invention may provide a step or ledge on the plastic tip to block light from passing between the plastic tip and the shield. In other embodiments of the present invention, a force may be exerted on the shield acting to keep the shield adjacent to, or in proximity of, the plastic tip. This force may be applied at a rear of the shield by one or more arms having ramped surfaces, where the arms are biased in an outward direction and the ramps are arranged to apply a force to the shield.

After a connector insert portion has been manufactured, a cable may be attached to it. The cable may include a ground shield or braiding. During cable attachment, the braiding may be pulled back and a ground cap may be placed over the braiding. The cap may then be crimped to secure the cable in place. The crimping may be done with a multi-section die, where contacting surfaces of the die include various points or peaks along their surface. These points may effectively wrinkle or jog the perimeter of the cap, thereby reducing the dimensions of a cross-section of the cable. This reduction in cross section may improve the flow of plastic while a strain relief is formed around the cable. This may, in turn, increase the manufacturability of the connector insert.

In various embodiments of the present invention, contacts, shields, and other conductive portions of connector inserts and receptacles may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connector inserts and receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector inserts and receptacles may provide pathways for signals that are compliant with various standards such as one of the Universal Serial Bus (USB) standards including USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector inserts and receptacles that may be used to provide a reduced set of functions for one or more of these standards. In various embodiments of the present invention, these interconnect paths provided by these connector inserts and receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
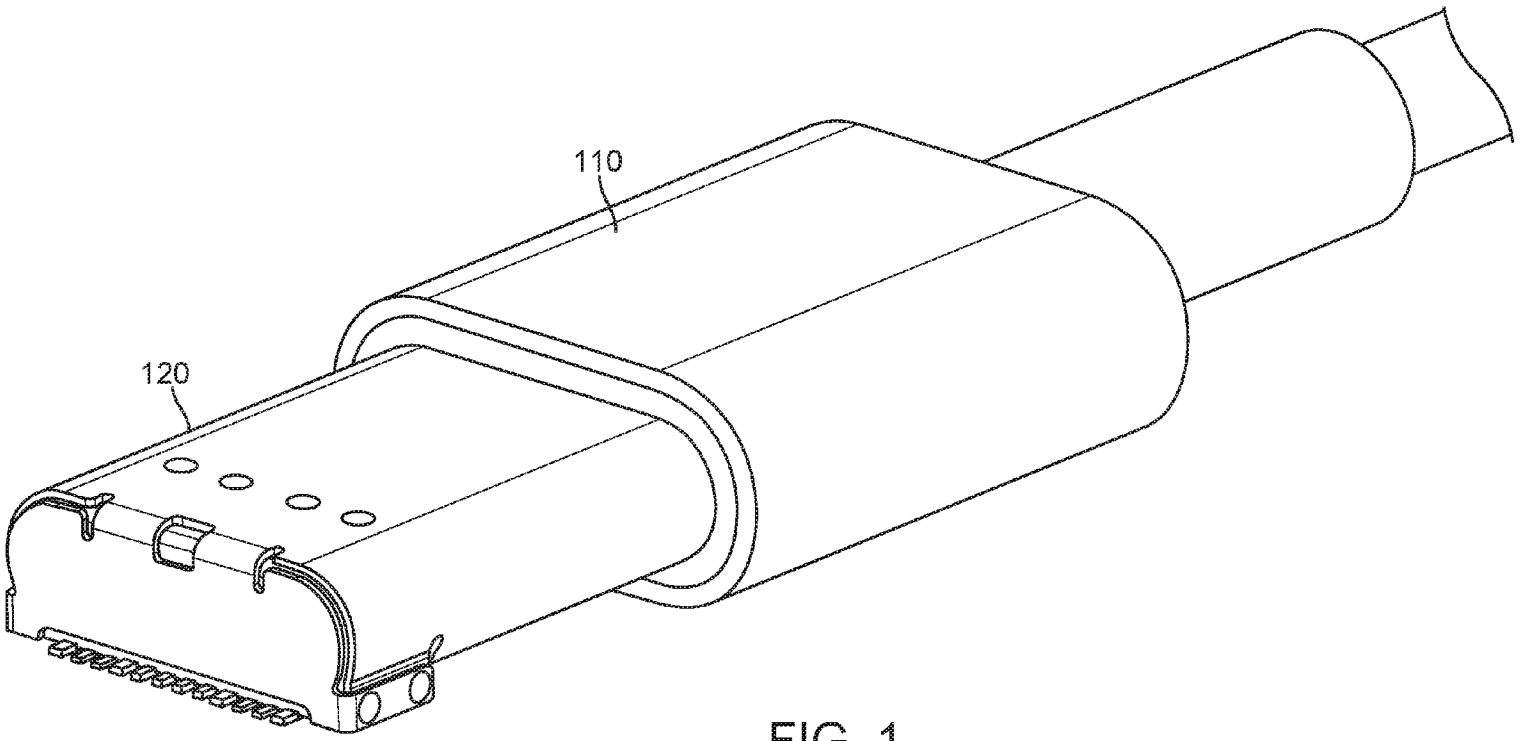
FIG. 1 illustrates a connector insert according to an embodiment of the present invention that has been inserted into a connector receptacle according to an embodiment of the present invention.

FIG. 1 illustrates a connector insert according to embodiments of the present invention that is been inserted into a connector receptacle according to an embodiment of the present invention. This figure, as with the other included figures, is shown for illustrative purposes and does not limit either the possible embodiments of the present invention or the claims.

Specifically, connector insert 110 has been inserted into connector receptacle 120. Receptacle 120 may be located in various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. Connector insert 110 and receptacle 120 may provide pathways for signals that are compliant with various standards such as one of the Universal Serial Bus (USB) standards including USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In other embodiments of the present invention, connector insert 110 and receptacle 120 may be used to provide a reduced set of functions for one or more of these standards. In various embodiments of the present invention, these interconnect paths provided by connector insert 110 and receptacle 120 may be used to convey power, ground, signals, test points, and other voltage, current, data, or other information. More information about connector insert 110 and receptacle 120 may be found in co-pending U.S. patent application Ser. No. 14/543,711, filed Nov. 17, 2014, titled CONNECTOR RECEPTACLE HAVING A SHIELD, which is incorporated by reference.

Connector insert 110 may include a number of contacts for conveying signals. These signals may include high-speed differential signals, as well as other types of signals. To increase signal integrity and reduce insertion losses, it may be desirable to increase an impedance of the signal contacts. This may be done by embodiments of the present invention by decreasing capacitances between the signal contacts in the connector insert to other conductive structures in the connector insert 110 and connector receptacle 120. This may be done by increasing the physical spacing between the signal contacts and these other structures.

Various connector receptacles may include ground structures, such as shields or center ground planes, or both. These shields and ground planes may have a particularly contour, which may be but is not necessarily flat. The signal contacts may then be designed to have a similar contour when they are deflected due to the connector insert being inserted into a connector receptacle. From this deflected shape, a non-deflected shape may be determined. From this non-deflected shape the contact may be formed. Variations between the shape of the contact and the shape of the ground structures may exist. These variations may be adjusted based at least in part on a desired contact force between the contact for the connector insert and a corresponding contact in a connector receptacle. This contact force may also at least partially account for differences between the deflected and non-deflected shapes of the contact for the connector insert. An example of this is shown in the following figures.

Figure 2:
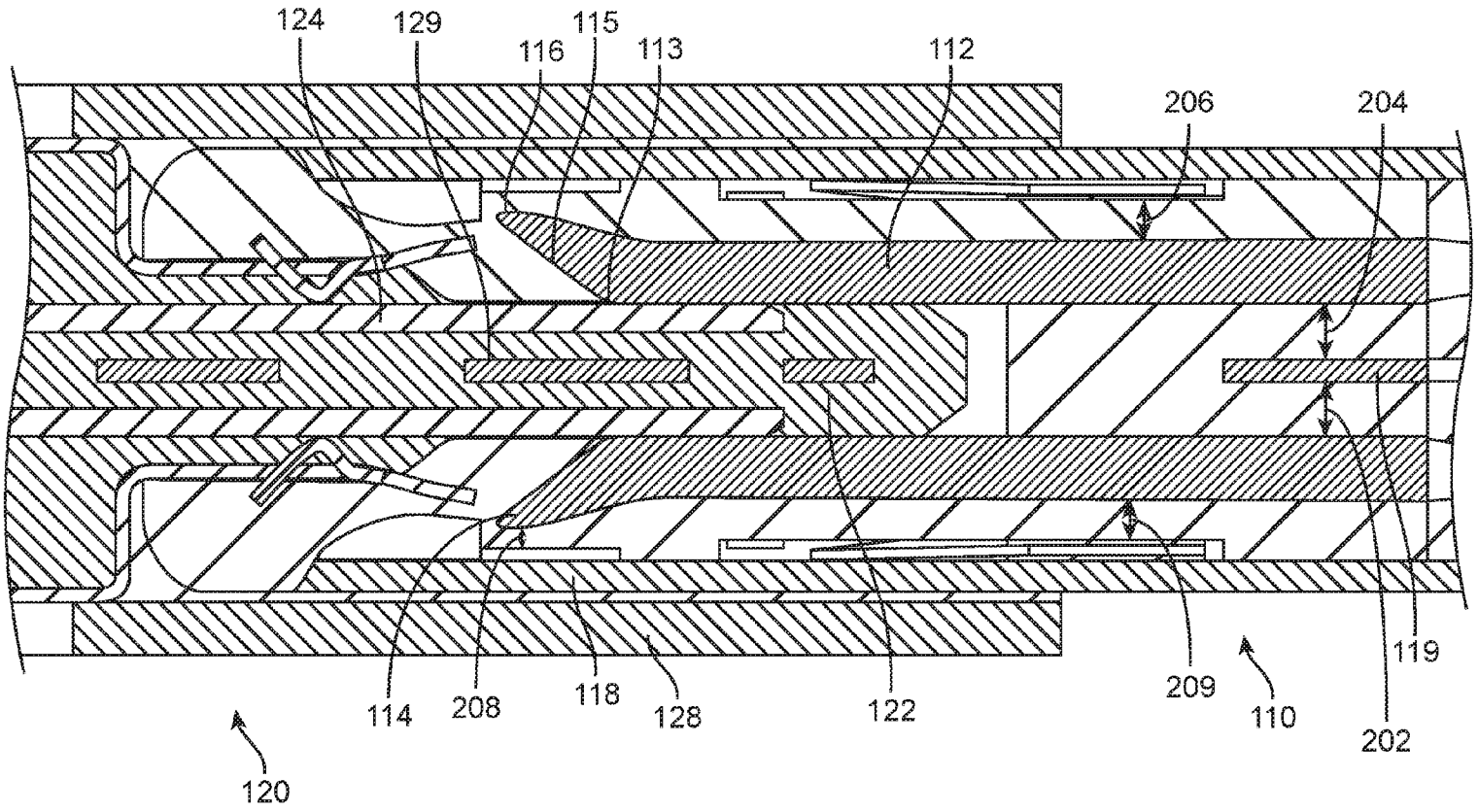
FIG. 2 illustrates a portion of a connector system according to an embodiment of the present invention.

FIG. 2 illustrates a portion of a connector system according to an embodiment of the present invention. This figure includes a connector insert 110 having signal contacts 112 and 114, shield 118, and center ground plane 119. This figure also includes a connector receptacle 120 including a tongue 122 having a center ground plane 129, shield 128, and contacts 124. Contacts 124 may engage contacts 112 and 114 at locations 113 when connector insert 110 is inserted into connector receptacle 120.

Since contacts 112 and 114 are between shield 118 (and shield 128) and central ground planes 119 and 129, contacts 112 and 114 may capacitively couple to shield 118 and center ground planes 119 and 129. This capacitance may increase with decreasing distance. This increase in capacitance may reduce the impedance at signal contacts 112 and 114, thereby reducing signal integrity.

Accordingly, embodiments of the present invention may reduce a thickness of one or more of signal contacts 112 and 114, shield 118, shield 128, and center ground planes 119 and 129. These decreasing thicknesses may increase a distance or spacing between these structures, thereby increasing impedance. In other embodiments of the present invention, signal contacts 112 and 114 may be contoured to increase distances, such as distances 202 and 204 to center ground planes 119 and 129, and distances 208 and 209 to shields 118 and their associated ground contacts. For example, where shield 128 and center ground plane 119 may be curved, contacts 112 and 114 may be curved as well in order to maximize these distances. In a special case as illustrated, center ground plane 119, center ground plane 129 in the connector receptacle tongue 122, and shields 118 and 128 have substantially straight or flat surfaces. Accordingly, signal contact 112 and 114 may be arranged to be substantially flat in a deflected state when in the connector insert is inserted into the connector receptacle.

Signal contacts 112 and 114 may be designed using a method according to an embodiment of the present invention, where the design process begins with signal contacts 112 and 114 in this nearly flat or straight deflected state. That is, signal contacts may be designed to follow the contours of the central ground planes 119 and 129 and shields 118 and 128 in the state where connector insert 110 is inserted into connector receptacle 120. A desired normal force at location 113 may be factored in as well. From this, a shape of signal contacts 112 and 114 in a non-deflected or extracted state may be determined. Signal contacts 112 and 114 may be manufactured in this state and used an embodiment of the present invention. This stands in contrast to conventional design techniques that begin by designing a signal contact in a non-deflected or non-inserted state.

Unfortunately, it may be problematic to form signal contacts 112 and 114 such that they are completely flat in a deflected state. For example, at least a slight amount of curvature at location 113 may be desirable such that contact is made between signal contact 112 in the connector insert and signal contact 124 in the connector receptacle. Specifically, without such curvature, a portion of connector insert signal contact 112 may rest on a front of the tongue 122. This may cause contact 112 to lift at location 113 and disconnect from connector receptacle contact 124. Also, to avoid tongue 122 from engaging an edge of signal contact 112 during insertion, a raised portion 115 having a sloped leading edge and a tip 116 may be included at an end of signal contact 112. This raised portion 115 may cause a localized drop or dip in the impedance of signal contact 112. To reduce this dip or reduction in impedance, raised portions 115 may have a substantially flat surface at tip 116 in an attempt to increase the distance between tip 116 and shield 118. That is, tip 116 may have a top surface that is substantially parallel to shield 118.

Figure 3:
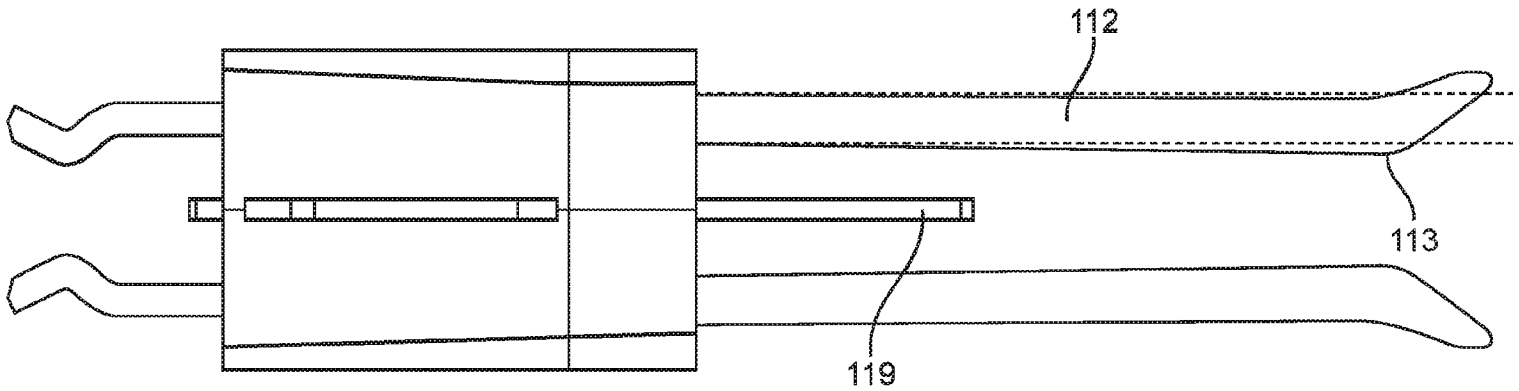
FIG. 3 illustrates signal contacts in a deflected or inserted state according to an embodiment of the present invention.

FIG. 3 illustrates signal contacts in a deflected or inserted state according to an embodiment of the present invention. As shown, contacts 112 may be substantially flat. Deviations from this at location 113 may be present, as described above. From this arrangement, as well as the desired force to be applied at location 113, the shape of signal contacts 112 in a non-deflected state may be determined. An example is shown in the following figure.

Figure 4:
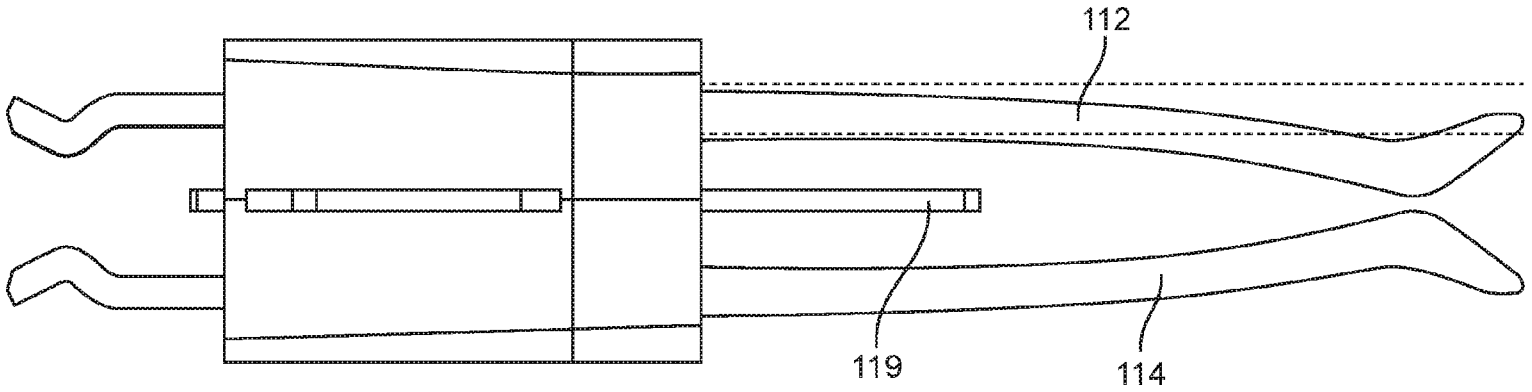
FIG. 4 illustrates signal contact in a non-deflected or extracted state according to an embodiment of the present invention.

FIG. 4 illustrates signal contact in a non-deflected or extracted state according to an embodiment of the present invention. As shown, contacts 112 and 114 may bend towards each other in the non-inserted state. Signal contacts 112 and 114 may be manufactured in the non-deflected state and used an embodiment of the present invention. Again, when the connector insert including contact 112 is inserted in a corresponding connector receptacle, contact 112 may defect to a substantially flat or straight position.

Various embodiments of the present invention may include a tip, formed of plastic or other material, on a front leading edge of a connector insert. In these embodiments of the present invention, it may be desirable to ensure that there are no gaps or spaces visible between the plastic tip and shield of a connector insert. Accordingly, embodiments of the present invention may provide features to reduce or limit these gaps. Examples are shown in the following figures.

Figure 5:
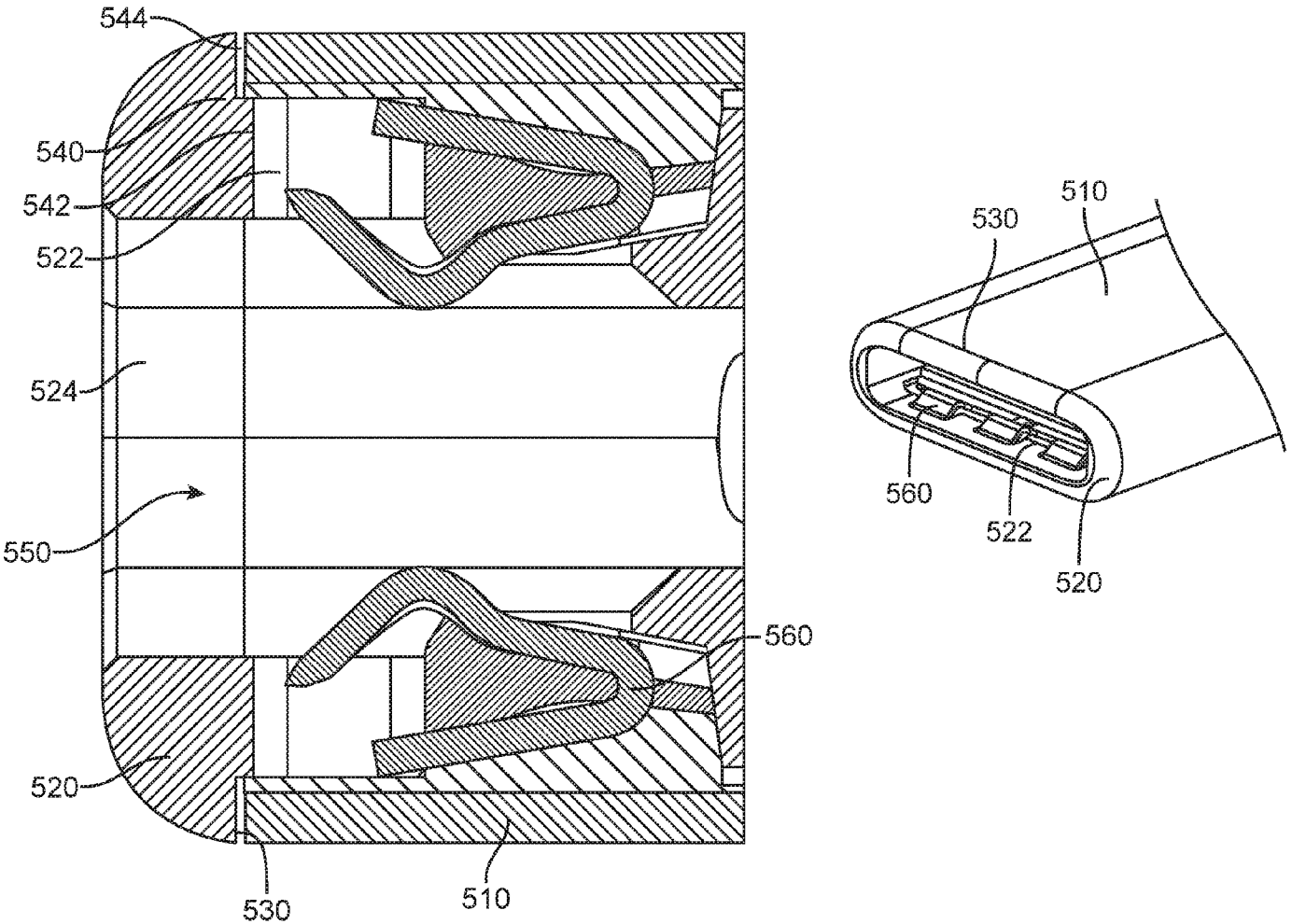
FIG. 5 illustrates a front end of a connector insert according to an embodiment of the present invention.

FIG. 5 illustrates a front end of a connector insert according to an embodiment of the present invention. In this example, plastic tip 520 may be located on a front of the connector insert next to shield 510. That is, shield 510 may meet the plastic tip 520 at a rear of the plastic tip 520 away from a front of the connector insert. While plastic tip 520 may be made of plastic, it may instead be formed of other non-conductive material. A plastic tip 520 may be used to avoid marring of the connector insert and corresponding connector receptacle and to preserve their appearance over time. Plastic tip 520 may also be durable as compared to metallic or other types of front ends. Plastic tip 520 may be a front end of a molded portion or housing 524 in the connector insert.

A gap 530 between plastic tip 520 and shield 510 may exist. This arrangement may allow light from opening 550 to pass through opening 522, which may be present for ground contacts 560 to electrically connect to shield 510, through gap 530 where it may be visible to a user. Accordingly, plastic tip 520 may include a ledge portion 540 to block light that may otherwise pass through gap 530. Specifically, ledge 540 may be present between edges 544 and 542. Ledge 540 may effectively cover an end of gap 530, thereby preventing light leakage. Put another way, opening 522 may be formed such that it has a leading edge 542 that is behind gap 530 in the direction away from the front opening of the connector insert.

In other embodiments of the present invention, a force may be applied to the remote end of shield 510 to reduce the gap 530 between shield 510 and plastic tip 520. An example is shown in the following figure.

Figure 6:
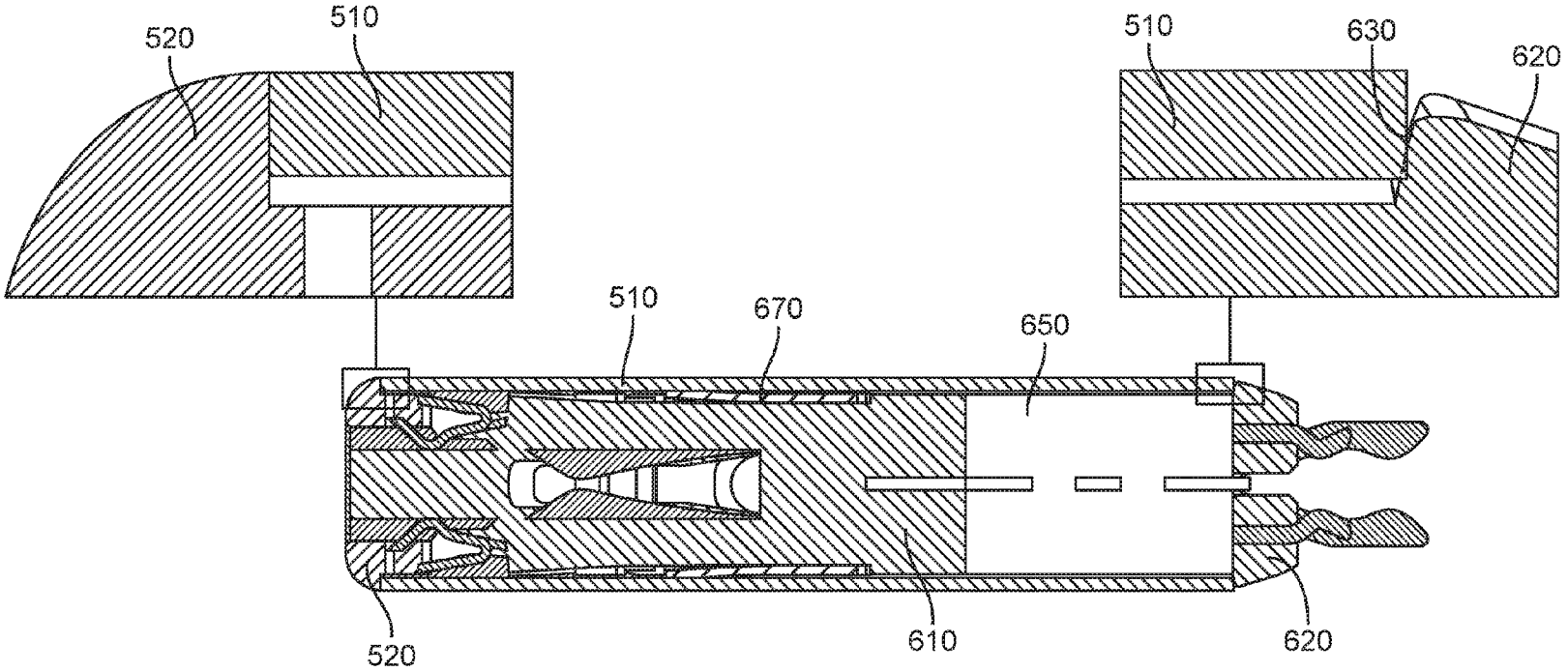
FIG. 6 illustrates a portion of a connector insert according to an embodiment of the present invention.

FIG. 6 illustrates a portion of a connector insert according to an embodiment of the present invention. In this example, shield 510 may be adjacent to or in close proximity to plastic tip 520. This close proximity may be caused by a force being applied to shield 510. Specifically, during assembly, arms 620 may be compressed or folded in closer to each other such that shield 510 may be slid over plastic portion 610. When shield 610 reaches plastic tip 520, arms 620 may be released, whereupon they may push out and against an end of shield 510. That is, arms 620 may be biased outward such that when they are released, they push out and against a rear portion of shield 510. Specifically, a surface 630 of arms 620 may be ramped or sloped such that a force is applied to shield 510 moving it adjacent to or in close proximity to plastic tip 520. A molded piece 650 may be inserted through a back end of shield 510 in order to force arms 620 outward, thereby holding shield 510 in place against plastic tip 520.

In this example, tape piece 670 may be included. Tape piece 670 may help to prevent signal contacts in the connector insert from contacting shield 510. Tape piece 670 may be sloped as shown so that it is not caught on the leading edge of shield 510 as shield 510 slides over plastic housing 610 during assembly.

Once this connector insertion portion is complete, a housing and cable may be attached to a rear portion of the assembly. This may be done in a way that avoids or reduces various problems in the manufacturing process An example is shown in the following figure.

Figure 7:
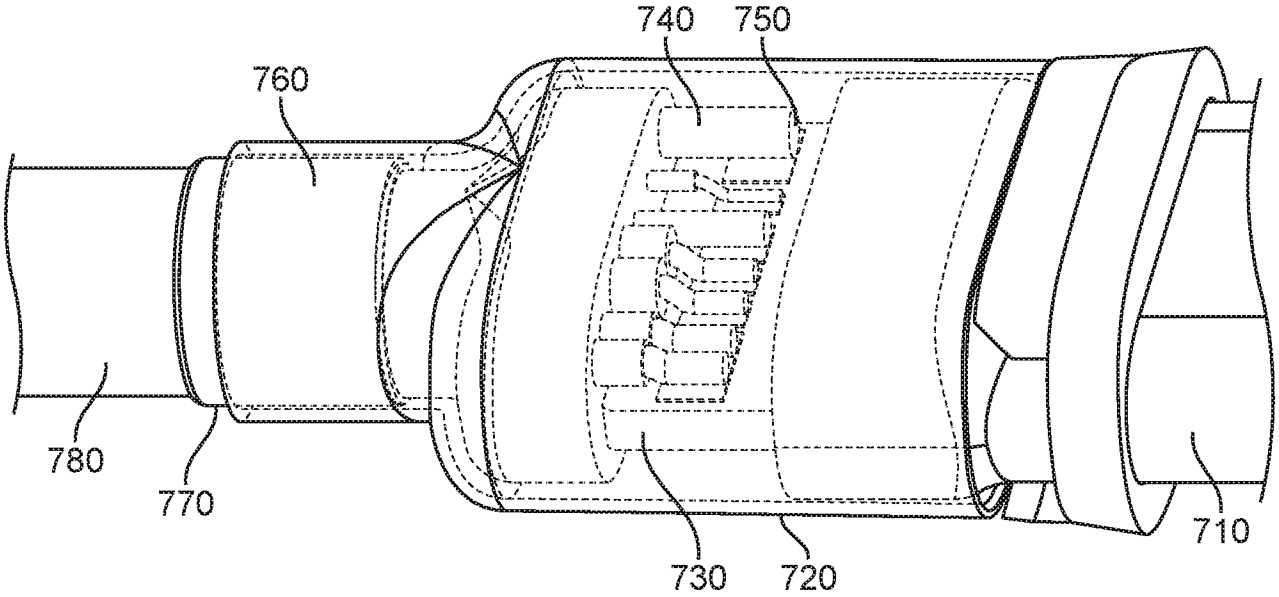
FIG. 7 illustrates a portion of a connector insert according to an embodiment of the present invention.

FIG. 7 illustrates a portion of a connector insert according to an embodiment of the present invention. In this example, cable 780 may pass through cap 770. Cap 770 may be covered or partially covered by strain relief 760. Conductors 740 in cable 780 may terminate on printed circuit board 730 at contacts 750. Traces (not shown) on printed circuit board 730 may connect contacts 750 to contacts in the connector insert. The printed circuit board 730 of a connector insert may be housed in housing 720.

Figure 8:
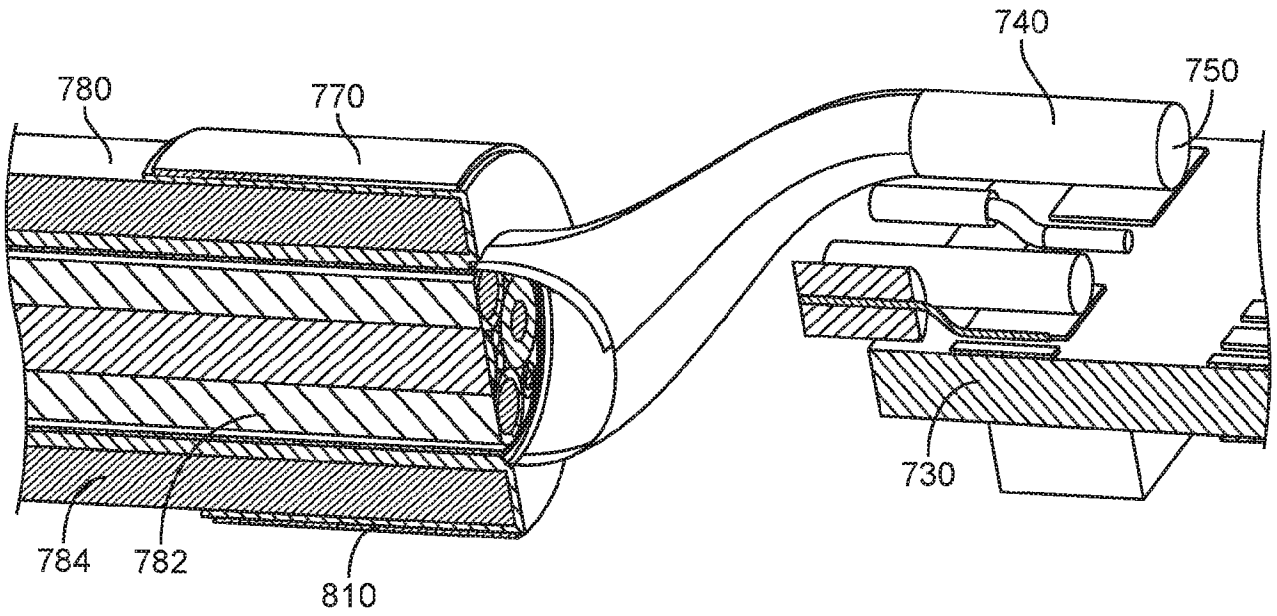
FIG. 8 illustrates a cutaway view of a portion of a connector insert according to an embodiment of the present invention.

FIG. 8 illustrates a cutaway view of a portion of a connector insert according to an embodiment of the present invention. Again, conductors 740 may terminate at pads 750 on printed circuit board 730. Braiding 810 of cable 780 may be folded back onto itself and crimped by cap 770. An example of how this crimping maybe done is shown in the following figure.

Figure 9:
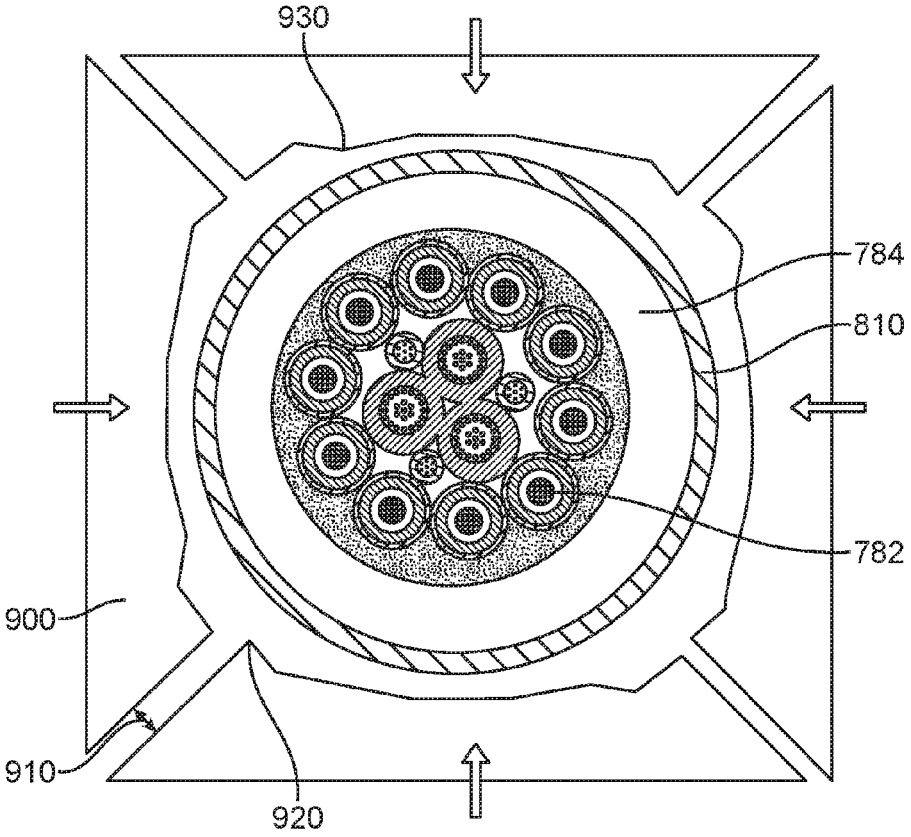
FIG. 9 illustrates a structure for crimping a cap around an end of a cable according to an embodiment of the present invention.

FIG. 9 illustrates a structure for crimping a cap around an end of a cable according to an embodiment of the present invention. In this example, four tool die pieces 900 may be used. These die pieces may be pushed inwards until gap 910 is reduced to a small or zero distance between each tool die 900. This may crimp cap 770 around the braiding 6410 of cable 780. The tool die piece 900 may include various points or peaks, such as 920 and 930. These points may effectively wrinkle or jog the perimeter of the cap, thereby reducing the dimensions of a cross-section of cable 780. This may improve the flow of plastic while forming strain relief 760 around cable 780.

In various embodiments of the present invention, contacts and other conductive portions of connector inserts and receptacles may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards used may be formed of FR-4, BT or other material. Printed circuit boards may be replaced by other substrates, such as flexible circuit boards, in many embodiments of the present invention.

Embodiments of the present invention may provide connector inserts and receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector inserts and receptacles may provide pathways for signals that are compliant with various standards such as one of the Universal Serial Bus (USB) standards including USB-C, High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector inserts and receptacles that may be used to provide a reduced set of functions for one or more of these standards. In various embodiments of the present invention, these interconnect paths provided by these connector inserts and receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector insert comprising:

a front housing portion;

a non-conductive tip around a front opening, the non-conductive tip having a first rear edge, a second rear edge behind the first rear edge, and a ledge between the first rear edge and the second rear edge;

a shield around the front housing portion, the shield meeting the non-conductive tip at the first rear edge of the non-conductive tip; and a ground contact near the front opening and located in an opening in the front housing portion to contact the shield, the opening in the front housing portion formed such that it is behind the second rear edge of the non-conductive tip.

2. The connector insert of claim 1 wherein the non-conductive tip is formed with the front housing portion.

3. The connector insert of claim 2 wherein the non-conductive tip is formed of plastic.

4. The connector insert of claim 1 further comprising a rear housing portion, wherein the rear housing portion is arranged to push the shield forward on the connector insert such that the shield remains in close contact with the first rear edge of the non-conductive tip.

5. The connector insert of claim 4 wherein the rear housing portion comprises a plurality of arms that are compressed toward each other during assembly to allow the shield to be slid over the rear housing portion and the front housing portion.

6. The connector insert of claim 5 wherein the arms have a sloped edge contacting the shield such that as the arms are released from compression they push the shield towards a front of the connector insert.

7. The connector insert of claim 4 wherein the rear housing portion and the front housing portion are formed as a single piece.

8. The connector insert of claim 4 wherein the rear housing portion and the front housing portion are formed as separate pieces.

9. A connector insert comprising:

a housing;

a central ground plane in the housing;

a shield around the housing and having a first contour;

a first plurality of contacts above the central ground plane, each having a shape in a deflected state to substantially match the first contour; and a second plurality of contacts below the central ground plane, each having a shape in a deflected state to substantially match the first contour.

10. The connector insert of claim 9 wherein there is a first variation between the shape of the contact and the first contour, wherein the first variation is determined at least in part based on a desired contact force.

11. The connector insert of claim 9 wherein the first contour is flat.

12. The connector insert of claim 9 wherein the central ground plane has a second contour, wherein each of the plurality of contacts have a shape to substantially match second first contour.

13. The connector insert of claim 12 wherein the second contour is flat.

14. The connector insert of claim 9 wherein each contact has an angled leading edge, the leading edge having a tip, the tip having a surface at least approximately parallel to the shield around the connector insert when the contact is in the deflected state.

15. A connector insert comprising:

a housing having a body and a plurality of flexible rear arms, where outer edges of the flexible rear arms are located at positions spaced further than the body of the housing and where the flexible rear arms may be compressed towards each other to be spaced narrower than the body of housing;

a front tip; and a shield over the body of the housing and between the front tip and the flexible rear arms and contacting the front tip and the flexible rear arms.

16. The connector insert of claim 15 further comprising a ground contact located in an opening in the housing near the front opening of the connector insert, where the opening for the ground contact has a front edge that is behind the rear of the front tip away from the front opening of the connector insert.

17. The connector insert of claim 16 where the front edge of the opening for the ground contact is behind a leading edge of the shield.

18. The connector insert of claim 15 wherein the flexible rear arms have a sloped leading edge contacting the shield such that as the arms are released from compression they push the shield towards the front tip.

19. The connector insert of claim 18 further comprising a rear housing portion, where the rear housing portion prevents the flexible rear arms from being compressed towards each after assembly.

20. The connector insert of claim 15 wherein the front tip is nonconductive and is a front end of the housing.

21. The connector insert of claim 1 wherein the shield and the ground contact are formed separately.

* * * * *